US008141993B2

(12) United States Patent
Kumagai et al.

(10) Patent No.: US 8,141,993 B2
(45) Date of Patent: Mar. 27, 2012

(54) FLUID EJECTING APPARATUS AND METHOD FOR TRANSPORTING FLUID

(75) Inventors: Toshio Kumagai, Shiojiri (JP); Jun Shimazaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 936 days.

(21) Appl. No.: 12/167,448

(22) Filed: Jul. 3, 2008

(65) Prior Publication Data

US 2009/0009544 A1 Jan. 8, 2009

(30) Foreign Application Priority Data

Jul. 5, 2007 (JP) ..... 2007-177609
Apr. 16, 2008 (JP) ..... 2008-107241

(51) Int. Cl.
*B41J 2/175* (2006.01)
*B41J 2/05* (2006.01)
*B41J 2/18* (2006.01)

(52) U.S. Cl. ..... 347/85; 347/57; 347/89

(58) Field of Classification Search ..... 347/57, 347/85, 89

See application file for complete search history.

(56) References Cited

U.S. PATENT DOCUMENTS

2006/0139419 A1* 6/2006 Shigemura ..... 347/85
2007/0115329 A1* 5/2007 Takatsuka ..... 347/57

FOREIGN PATENT DOCUMENTS

JP 09-234886 9/1997
JP 2001-219580 8/2001
JP 2006-168023 6/2006

* cited by examiner

*Primary Examiner* — Matthew Luu
*Assistant Examiner* — Jannelle M Lebron
(74) *Attorney, Agent, or Firm* — Workman Nydegger

(57) ABSTRACT

A fluid ejecting apparatus including a head that ejects fluid, a first fluid storing section for storing the fluid that is located below the head, a second fluid storing section for storing the liquid that is located above the first fluid storing section, a pumping mechanism capable of moving the fluid from the first fluid storing section to the second fluid storing section through the head, and a controller that alternates between a first control mode wherein the pumping mechanism moves the fluid from the first fluid storing section to the second fluid storing section and a second control mode in which the fluid is allowed to flow from the second fluid storing section to the first fluid storing section through the head. Upon receiving an instruction to turn off the power, the controller shifts to the second control mode and then turns off the power.

17 Claims, 8 Drawing Sheets

FLUID EJECTING APPARATUS AND METHOD FOR TRANSPORTING FLUID

BACKGROUND OF THE INVENTION

The entire disclosure of Japanese Patent Application No. 2007-177609, filed Jul. 5, 2007 and Japanese Patent Application No. 2008-107241, filed Apr. 16, 2008 are expressly incorporated herein by reference.

TECHNICAL FIELD

The present invention relates to a fluid ejecting apparatus. More specifically, the present invention relates to a fluid supply within a fluid ejecting apparatus and a method for transporting fluid in the fluid ejecting apparatus.

RELATED ART

In many fluid ejecting apparatuses currently known in the art, the apparatus is equipped with a recording head for ejecting fluid, a first fluid storing section located lower than the recording head for storing the fluid, a second fluid storing section located higher than the first fluid storing section for storing the fluid, and a pumping mechanism for drawing up the fluid from the first fluid storing section to the second fluid storing section through the recording head. One example of one such fluid ejecting apparatus disclosed in Japanese Patent No. JP-A-9-234886, which comprises a fluid ejecting apparatus which includes a controller that controls a first control mode which causes the pumping mechanism to move the fluid from the first fluid storing section to the second fluid storing section and a second control mode wherein the fluid is allowed to flow from the second fluid storing section to the first fluid storing section through the recording head.

In the disclosed fluid ejecting apparatus, the controller alternates between the first control mode and the second control mode, so that the fluid flows back and forth between the first fluid storing section and the second fluid storing section through the recording head. This allows the fluid to flow through the recording head without stopping.

One problem with the disclosed apparatus, however, is that the back-and-forth flow of the fluid between the first fluid storing section and the second fluid storing section through the recording head is executed when the power to the fluid ejecting apparatus is ON, meaning that the fluid does not accumulate in the recording head when the apparatus is ON, but when the power to the fluid ejecting apparatus is OFF, the fluid accumulates in the recording head.

BRIEF SUMMARY OF THE INVENTION

An advantage of some aspects of the invention is that fluid is able to flow through the recording head when there is no power being supplied to the fluid ejecting apparatus.

A first aspect of the invention is a fluid ejecting apparatus including a recording head that is capable of ejecting fluid, a first fluid storing section located lower than the recording head which is capable of storing the fluid, a second fluid storing section located higher than the first fluid storing section which is also capable of storing the fluid, a pumping mechanism that is capable of causing the fluid from the first fluid storing section to move through the recording head to the second fluid storing section, and a controller that is capable of controlling the pumping mechanism by alternating between a first control mode wherein the pumping mechanism causes the fluid from the first fluid storing section to move to the second fluid storing section and a second control mode wherein the fluid is allowed to flow from the second fluid storing section to the first fluid storing section through the recording head. In the fluid ejecting apparatus, when the controller receives a command to terminate the power to the apparatus, the controller shifts to the second control mode and then terminates the power to the fluid ejecting apparatus.

A second aspect of the invention is a method for transporting fluid, comprising alternating the control mode sent to a pumping mechanism between a first control mode and a second control mode during the during the period of time between when the power to the fluid ejecting apparatus is turned on until a the time when the fluid ejecting apparatus receives a power-off instruction, wherein the first control mode causes a pumping mechanism to move the fluid from a first fluid storing section to a second fluid storing section located higher than the first fluid storing section through a fluid ejecting recording head located higher than the first fluid storing section, and the second control mode causes the fluid to flow from the second fluid storing section to the first fluid storing section through the recording head, receiving a power-off instruction, shifting the mode to second control mode, and turning off the power to the fluid ejecting apparatus.

Thus, in each aspect of the invention, the fluid stored in the second fluid storing section flows to the first fluid storing section through the recording head after the power is turned off. Thus, the fluid can flow through the recording head after the power is turned off.

These and other features will become apparent by referring to the following description and appended drawings. At least the following features will become more apparent in the description and appended drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Structural Example of Fluid Ejecting Apparatus of Embodiment

Figure 1:
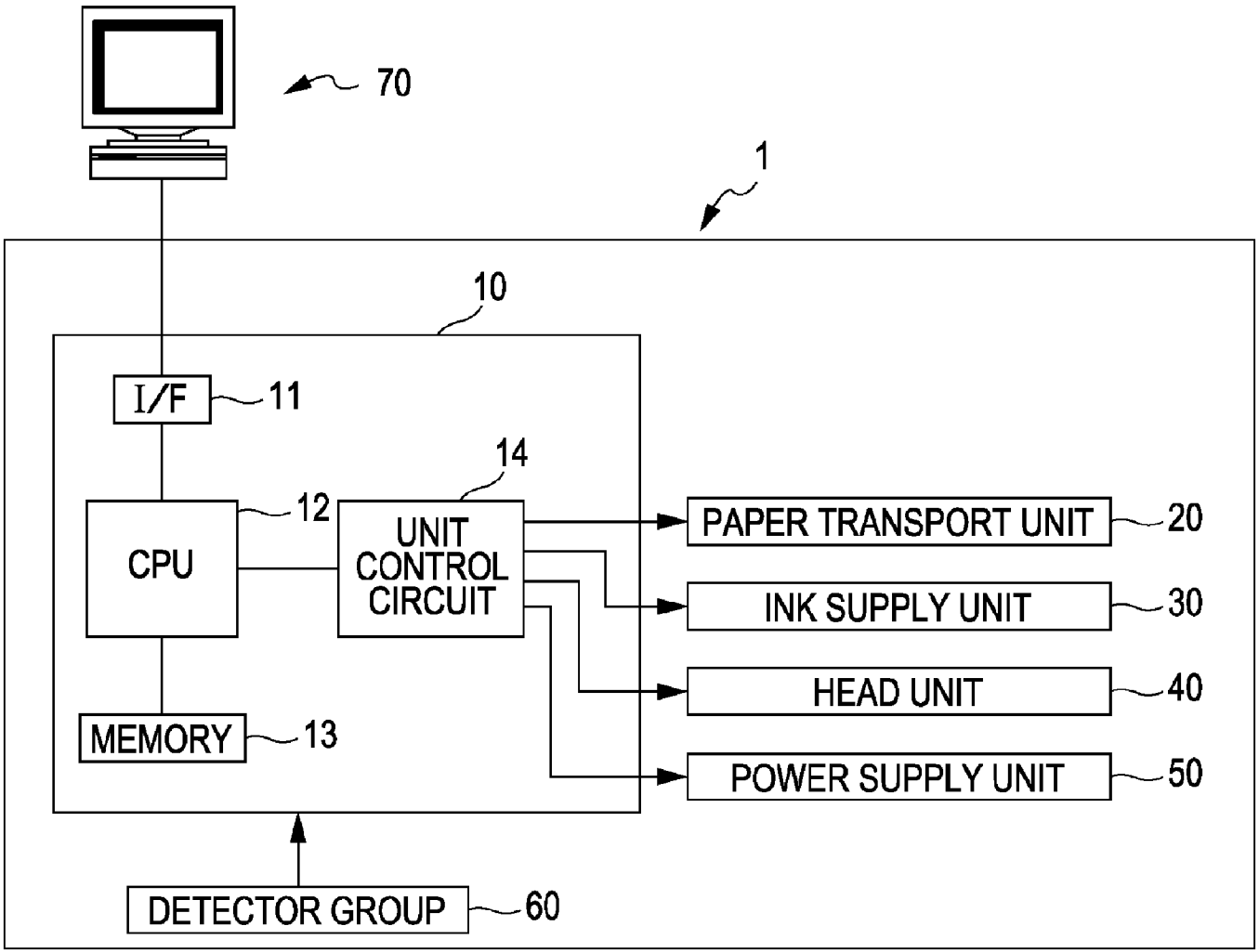
FIG. 1 is a block diagram of a printer according to an embodiment of the invention.
Figure 2:
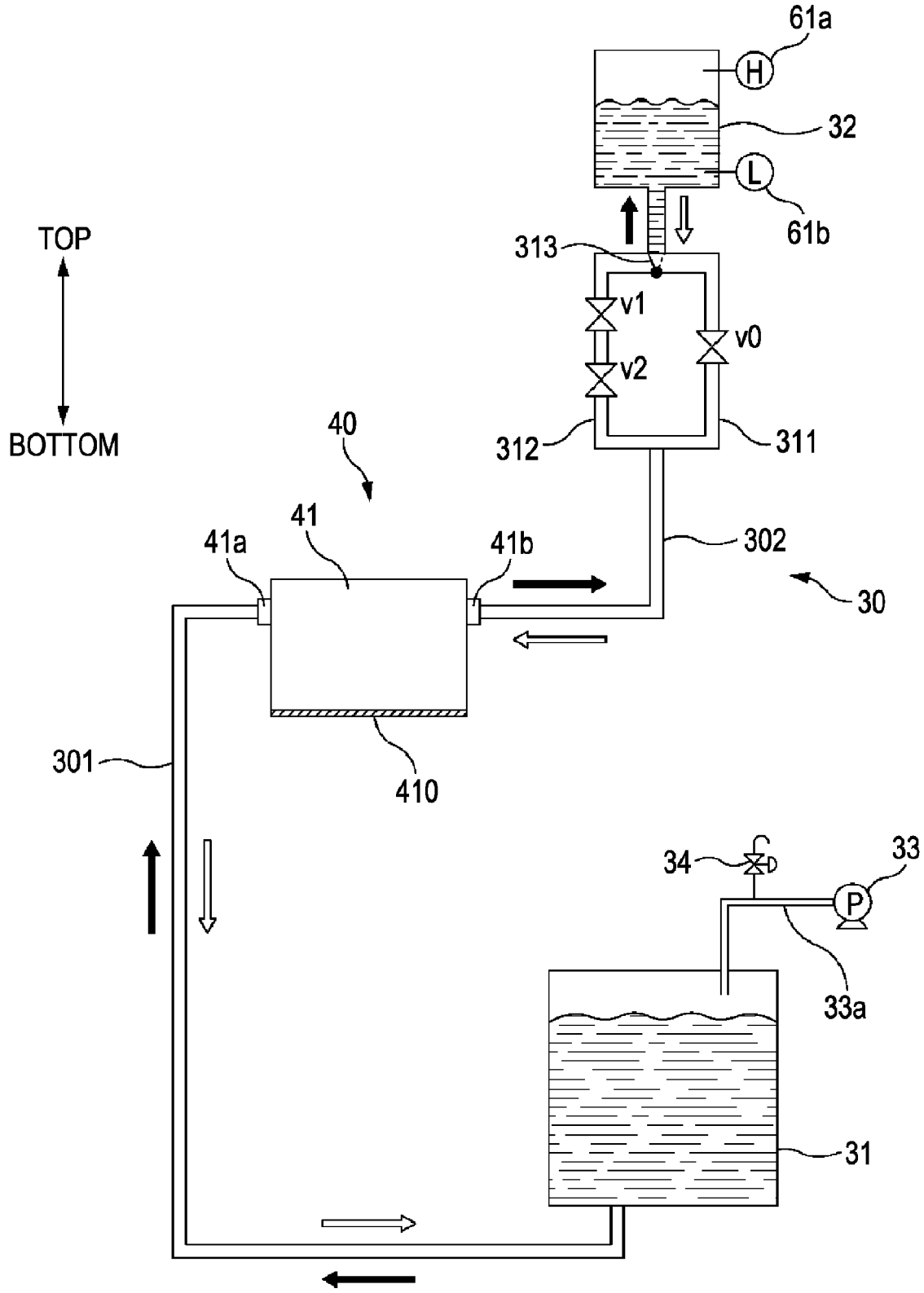
FIG. 2 is a diagram showing the structure of an ink supply unit and a recording head unit.
Figure 3:
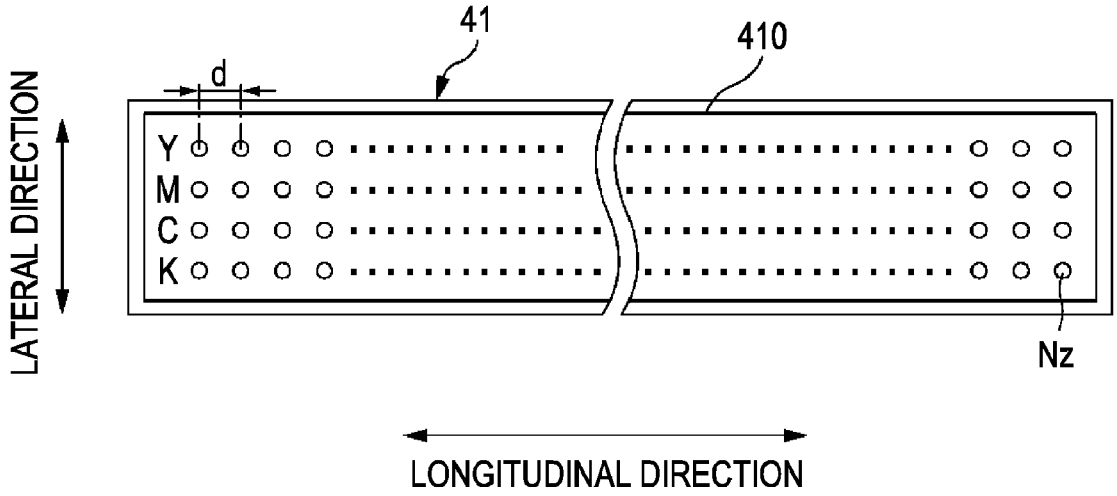
FIG. 3 is a schematic diagram showing the arrangement of the nozzles on the lower surface of a recording head.

An ink jet printer (hereinafter, referred to as a printer 1) is used herein as an example of a fluid ejecting apparatus capable of performing the aspects of the invention. The printer 1 will be described with reference to FIGS. 1 to 3. FIG. 1 is a block diagram of the printer 1 according to an embodiment of the invention. FIG. 2 is a conceptual diagram showing the structure of an ink supply unit 30 and a recording head unit 40 in the vertical direction. FIG. 3 is a schematic diagram showing the arrangement of the nozzles on the lower surface of a recording head 41

The printer 1 of this embodiment is a line recording head printer. Upon receiving print data from an external computer 70, the printer 1 ejects a fluid, such as ink onto a piece of paper in order to print an image onto the paper that corresponds to the print data. As shown in FIG. 1, the printer 1 is equipped with a controller 10, paper transport unit 20, ink supply unit 30, recording head unit 40, and a power supply unit 50.

The controller 10 controls the components of the printer 1, namely the paper transport unit 20, the ink supply unit 30, the recording head unit 40, and the power supply unit 50. The controller 10 includes an interface 11 (denoted as "I/F" in FIG. 1), a CPU 12, a memory 13, and a unit control circuit 14. The CPU 12 is a processing unit for controlling the printer 1, and controls the components of the printer 1 using the unit control circuit 14 according to a program stored in the memory 13.

The paper transport unit 20 includes a transport roller (not shown). The paper transport unit 20 feeds paper to a printable position by rotating the transport roller in order to transport a fixed amount of the paper in a predetermined direction.

The ink supply unit 30, described more fully below, supplies ink to the recording head 41 of the recording head unit 40. The ink supply unit 30 is provided for each of a plurality of ink colors (in this embodiment, yellow Y, magenta M, cyan C, and black B). FIG. 2 shows only one ink supply unit 30 for one color for the convenience of description. As shown in FIG. 2, the ink supply unit 30 for each color includes a main tank 31 comprises a first fluid storing section and a subtank 32 comprises a second fluid storing section. The main tank 31 and the subtank 32 each store ink. The ink stored in the tanks 31 and 32 is supplied to the recording head 41 connected to the tanks 31 and 32 through the ink channels, more precisely, a first channel 301 and a second channel 302, described more fully below. In other words, the main tank 31 and the subtank 32 communicate with each other through the ink channels 301 and 302 and the recording head 41. Accordingly, the ink is allowed to flow back and forth between the main tank 31 and the subtank 32 while supplying the ink to the recording head 41. The details of the ink supply unit 30 will be described later.

The recording head unit 40 prints an image onto paper by ejecting the ink supplied from the ink supply unit 30 onto the paper in the form of a plurality of dots. The recording head unit 40 according to the embodiment can eject ink across the entire width of the paper. Thus the recording head unit 40 has a recording head 41 that with a length that is greater than the width of the paper. The recording head 41 is fixed such that its longest side corresponds with the width of the paper transported through the printer 1 (referred to as the longitudinal direction in FIG. 3), with its shorter sides corresponding to the direction that paper is transported through the printer 1 (referred to as the lateral direction). As shown in FIG. 3, a nozzle plate 410 provided on the lower surface of the recording head 41 has four nozzle trains, a black-ink nozzle train (nozzle train K), a cyan-ink nozzle train (nozzle train C), a magenta-ink nozzle train (nozzle train M), and a yellow-ink nozzle train (nozzle train Y). The nozzle trains each have a plurality of nozzles arrayed at a regular interval d along the paper width, in the longitudinal direction of the recording head 41. The nozzles Nz that comprise the nozzle trains eject ink of a corresponding color. The structure of the nozzles Nz of the recording head 41 will be described more fully below.

The power supply unit 50 supplies power to the components of the printer 1. When the user of the printer 1 sends a request to turn on the printer, by turning on the power switch (not shown) of the printer 1 or the like, the controller 10 receives a power-on instruction. The controller 10 then instructs the power supply unit 50 to supply power to the components of the printer 1. In contrast, when the sends a request to turn off the printer, by turning off the power switch, or the like, the controller 10 sends an instruction to the power supply unit 50 to end the supply of power to the components of the printer 1. In the following description, "the controller 10 turns off the power" indicates that the controller 10 causes the power supply unit 50 to end the power supply.

A detector group 60 has a plurality of detectors that monitor the state of the printer 1. The results of these detections by the detector group 60 are output to the controller 10. The controller 10 controls the components of the printer 1 according to the detection results using the unit control circuit 14. The detector group 60 includes level switches 61*a* and 61*b*, shown in FIG. 2, which are examples of signal output sections that may be mounted in the subtank 32. When the level of the ink in the subtank 32 reaches a predetermined level, the level switches 61*a* and 61*b* output a signal responsive to the level to the controller 10.

Structure around Nozzles

Figure 4:
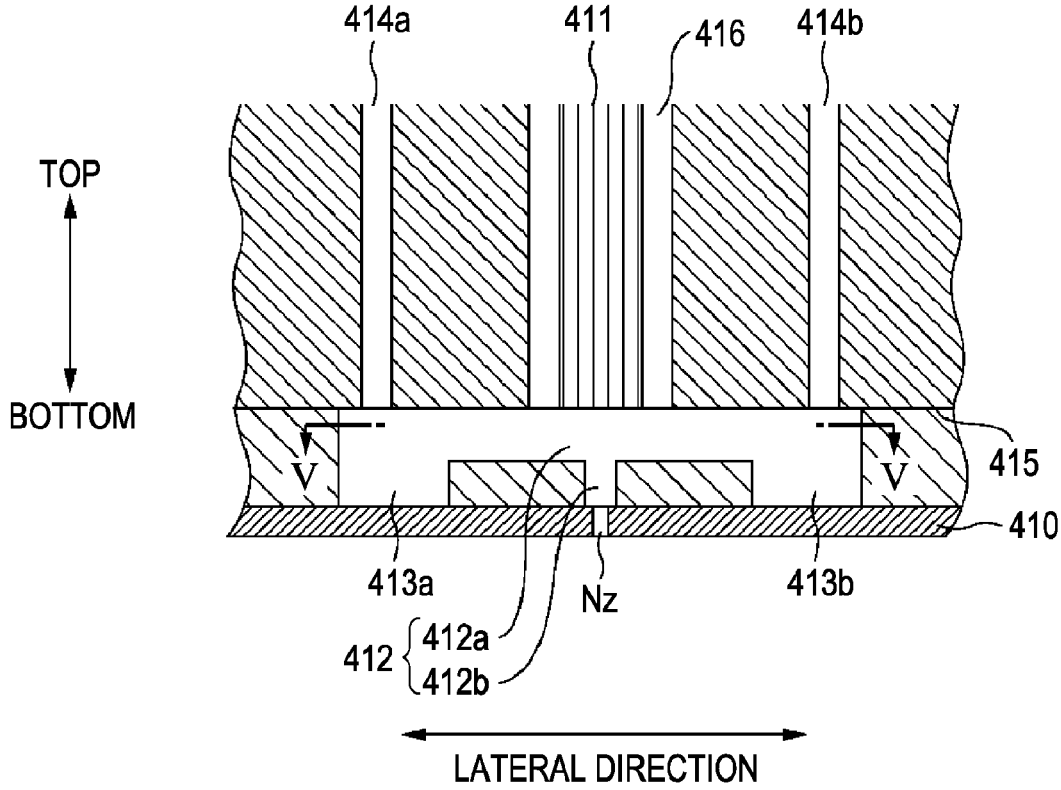
FIG. 4 is a schematic diagram of the structure around the nozzle.
Figure 5:
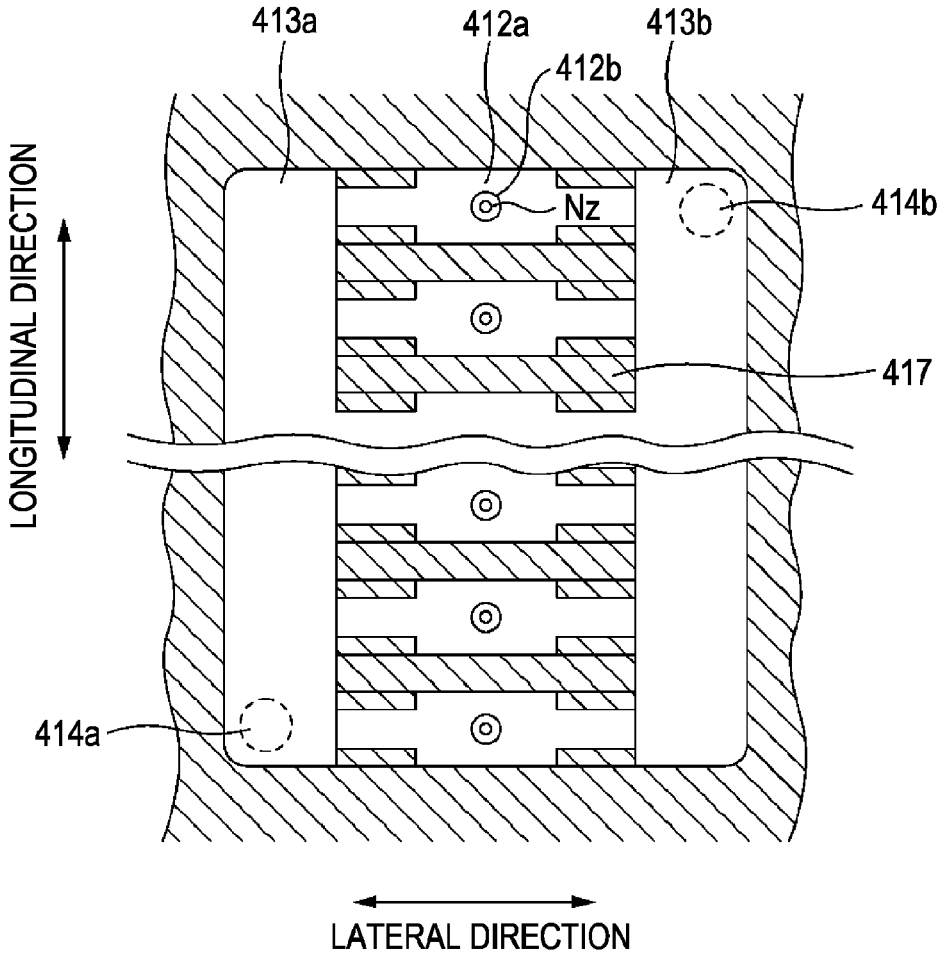
FIG. 5 is a cross sectional view taken along line V-V of FIG. 4.

FIGS. 4 and 5 describe the structure of the nozzles Nz of the recording head 41. FIG. 4 is a schematic cross sectional view of the structure around the nozzles Nz formed in the nozzle plate 410, in which the nozzles Nz extend along the longitudinal direction of the recording head 41. The arrows in FIG. 4 illustrate the vertical and horizontal alignment of the printer 1 and recording head 41. FIG. 5 is a schematic cross sectional view taken along line V-V of FIG. 4.

The recording head 41 has a plurality of nozzle trains (four, in this embodiment) which extend along the longitudinal direction of the recording head 41. As shown in FIGS. 4 and 5, each of the nozzles Nz of the nozzle trains has a piezoelectric element 411 or other driving element for ejecting ink from the nozzle Nz, along with a pressure chamber 412. The recording head 41 further has first and second reservoirs 413*a* and 413*b* and first and second inlet and outlet channels 414*a* and 414*b* which form a common ink chamber that is supplies each of the nozzles Nz of a single nozzle train. The recording head 41 further has an elastic plate 415 which partitions the pressure chamber 412 from an element chamber 416 which contains the piezoelectric element 411 and which is deformed with the motion of the piezoelectric element 411.

The piezoelectric element 411 is accommodated in the element chamber 416 and, as shown in FIG. 4, the lower end of the piezoelectric element 411 is bonded to the elastic plate 415, as described more fully below. The piezoelectric element 411 expands and contracts according to a drive pulse contained in a driving signal output from the unit control circuit 14.

The elastic plate 415 seals the upper opening of the pressure chamber 412 and the first and second reservoirs 413*a* and 413*b* and the lower opening of the element chamber 416. The part of the elastic plate 415 in contact with the piezoelectric element 411 is hereinafter, referred to as a diaphragm. The diaphragm warps vertically with the expansion and contraction of the piezoelectric element 411.

The pressure chamber 412 is a space located opposite to the element chamber 416 with the elastic plate 415 therebetween. As shown in FIGS. 4 and 5, the pressure chamber 412 has a flat portion 412*a* which is divided by a partition 417 and a circular lead-in hole 412*b* adjacent to the nozzle Nz, wherein the ink is introduced from the flat portion 412*a* into the nozzle Nz. Thus, the ink that has flowed to the flat portion 412*a* is supplied to the nozzle Nz through the lead-in hole 412*b*. As shown in FIG. 5, both ends of the flat portion 412*a* in the lateral direction are narrower than at the center of the recording head 41.

The first and second reservoirs 413*a* and 413*b* are capable of storing ink. In this embodiment, as shown in FIGS. 4 and 5, the first and second reservoirs 413*a* and 413*b* off to each side of the pressure chamber 412 in the lateral direction of the recording head 41. The first and second reservoirs 413*a* and 413*b* communicate with each other through the pressure chamber 412. This allows the ink stored in the first and second reservoirs 413*a* and 413*b* to flow between the first and second reservoirs 413*a* and 413*b*.

As shown in FIG. 4, the first and second inlet and outlet channels 414*a* and 414*b* vertically pass through the side walls of the element chamber 416. The lower ends of the first and second inlet and outlet channels 414*a* and 414*b* are connected to the first and second reservoirs 413*a* and 413*b* through the elastic plate 415, respectively. As shown in FIGS. 4 and 5, the first inlet and outlet channel 414*a* is connected to the first reservoir 413*a* at one end of the length of the recording head 41, while the second inlet and outlet channel 414*b* is connected to the second reservoir 413*b* at the other end of the length. The first inlet and outlet channel 414*a* extends from the first reservoir 413*a* to a first connection port 41*a* which is connected with the first channel 301, described more fully below. On the other hand, the second inlet and outlet channel 414*b* extends from the second reservoir 413*b* to a second connection port 41*b* which is connected to the second channel 302 that is also described more fully below. This allows ink to flow in and out between the first reservoir 413*a* and the main tank 31 through the first inlet and outlet channel 414*a*, and flow in and out between the second reservoir 413*b* and the subtank 32 through the second inlet and outlet channel 414*b*.

The above structure allows ink that has flowed into the subtank 32 of the recording head 41 from the main tank 31 to flow into the first and second reservoirs 413*a* and 413*b* through the first inlet and outlet channel 414*a* and the second inlet and outlet channel 414*b*, respectively. The ink that is stored in the first and second reservoirs 413*a* and 413*b*, then flows into the pressure chamber 412, where it is finally supplied to each nozzle Nz through the lead-in hole 412*b* of the pressure chamber 412. Thus, the first and second inlet and outlet channels 414*a*, the first and second reservoirs 413*a* and 413*b*, and the pressure chamber 412 constitute ink channels of the recording head 41. More specifically, the first and second inlet and outlet channels 414*a* and 414*b* and the first and second reservoirs 413*a* and 413*b* form a common ink channel through which ink is supplied to the nozzles Nz, while the pressure chamber 412 forms individual ink channels which supply the nozzles Nz.

When the piezoelectric element 411 expands and contracts with the pressure chamber 412 filled with ink, the diaphragm of the elastic plate 415 is warped with the expansion and contraction of the piezoelectric element 411, causing the capacity of the pressure chamber 412 to change. As a result of changing capacity of the pressure chamber 412, the interior pressure of the pressure chamber 412 (more precisely, the pressure of the ink that fills the pressure chamber 412) changes. Thus ink is ejected from the nozzles Nz according to the changes in the interior pressure. The ink in the nozzles Nz is held in the nozzles Nz while forming a meniscus (see FIG. 6).

Ink Supply Unit of the Embodiment

Referring back to FIG. 2, the ink supply unit 30 will now be described in detail.

As shown in FIG. 2, the ink supply unit 30 includes a main tank 31, subtank 32, first and second channels 301 and 302, pressure pump 33 corresponding to a pumping mechanism, and an air release valve 34.

As shown in FIG. 2, the main tank 31 is below the recording head 41 in the printer 1, and is detachably mounted to the printer main body. The printer main body is the part of the printer 1 except the main tank 31. The interior of the main tank 31 is hermetically sealed, the ceiling of which is connected to a pressure line 33*a* for pressurizing the vapor phase area of the main tank 31.

As shown in FIG. 2, the subtank 32 is integrated with the printer main body and is located above the recording head 41 of the printer 1 (in other words, the subtank 32 is located above the main tank 31). The capacity of the subtank 32 is smaller than that of the main tank 31. The interior of the subtank 32 is hermetically sealed. The level of the ink stored in the subtank 32 (the height of the liquid surface of the ink in the subtank 32) is monitored by the level switches 61*a* and 61*b*. More specifically, when the ink in the subtank 32 reaches a predetermined maximum level, the level switch 61*a* (denoted by symbol H in FIG. 2, hereinafter, referred to as an upper level switch 61*a*) which is mounted at a higher position in the subtank 32 outputs a first level signal to the controller 10. The first level signal is a signal that the upper level switch 61*a* outputs when the ink in the subtank 32 increases to the predetermined maximum level. On the other hand, when the ink level reaches the predetermined minimum level, the level switch 61*b* (denoted by symbol L in FIG. 2, hereinafter, referred to as a lower level switch 61*b*) mounted at the lower position outputs a second level signal to the controller 10. The second level signal is a signal that the lower level switch 61*b* outputs when the ink in the subtank 32 decreases to the predetermined minimum level.

The first and second channels 301 and 302 are ink transporting channels formed of tubes and joints made of resin such as fluoroethylene plastics. The first channel 301 connects the main tank 31 and the recording head 41 (more precisely, the first connection port 41*a* of the recording head 41). The second channel 302 connects between the subtank 32 and the recording head 41 (more precisely, the second connection port 41*b* of the recording head 41).

As shown in FIG. 2, the second channel 302 is divided into two branches in the middle which are subsequently rejoined. The two branch channels each have a valve (denoted by v0, v1, and v2 in FIG. 2). A first channel of the two branch channels has more valves than the second channel. The opening of the valve of the first channel, denoted by v1, is smaller than that of the valve of the second channel, denoted by v0. Accordingly, the resistance of the first channel is higher than that of the second channel. Of the two branch channels, the second channel with lower resistance is hereinafter referred to as a low-resistance channel 311, and the first channel with higher resistance is referred to as a high-resistance channel 312.

The junction where the low-resistance channel 311 and the high-resistance channel 312 meet the subtank 32 has a channel selector valve 313, as shown in FIG. 2. The channel selector valve 313 switches between the low-resistance channel 311 and the high-resistance channel 312 in order to select where the ink flows between the low-resistance channel 311 and the high-resistance channel 312. More specifically, when the channel selector valve 313 is in the position indicated by the solid line in FIG. 2, the low-resistance channel 311 is opened and the high-resistance channel 312 is closed. In contrast, when the channel selector valve 313 is in the position indicated by the dotted line in FIG. 2, the high-resistance channel 312 is opened and the low-resistance channel 311 is closed. The switching between the low-resistance channel 311 and the high-resistance channel 312 is executed by the controller 10 controlling the channel selector valve 313.

The pressure pump 33 applies pressure to the vapor phase area in the main tank 31 by applying pressurized air into the main tank 31 through the pressure line 33*a* described above. More specifically, when the pressure pump 33 is activated and the air release valve 34 described below is closed, the air pressure in the main tank 31 increases. Thus, the ink in the main tank 31 is pushed out of the main tank 31. The ink is pushed from the main tank 31, where it flows in the direction indicated by the black solid arrows in FIG. 2 through the first channel 301 to the recording head 41, where it is finally drawn up to the subtank 32 through the second channel 302.

The air release valve 34 is a valve for releasing the air pressure in the main tank 31 when it is increased by the operation of the pressure pump 33 in order to return the pressure to the previous atmospheric pressure. After the ink is drawn up to the subtank 32 by the pressure pump 33, the pressure pump 33 is stopped and the air release valve 34 is opened, with the ink held in the subtank 32, causing the ink to flows in the direction indicated by the outlined arrows shown in FIG. 2 by the difference in the water head between the subtank 32 and the main tank 31. In other words, the ink in the subtank 32 flows naturally to the main tank 31 through the recording head 41. The driving of the pressure pump 33 and the switching of the air release valve 34 are controlled by the controller 10.

The ink supply unit 30 of the above structure allows the ink to flow between the main tank 31 and the subtank 32 through the recording head 41, or more precisely, through an ink channel formed in the recording head 41. In other words, the operation of driving the pressure pump 33 is repeated, with the air release valve 34 closed, causing the ink to be draw up from the main tank 31 to the subtank 32. When the operation of the pressure pump 33 is stopped and the air release valve 34 is opened, the ink is allowed to flow naturally from the subtank 32 to the main tank 31. While the ink flows between the main tank 31 and the subtank 32 passes through the recording head 41, the ink is supplied to the recording head 41. In other words, the recording head 41, the first channel 301, and the second channel 302 are continuously supplied with ink. Accordingly, when the ink is ejected from the nozzles Nz, the ink in the recording head 41 is consumed, the recording head 41 is immediately replenished with ink equal to the amount that was consumed. In this embodiment, the main tank 31, is detachable as described above, and may be replaced with a new main tank 31 filled with ink when the ink is so depleted that the ink in the subtank 32 cannot reach the uppermost level when drawn up from the main tank 31 to the subtank 32.

Back-and-Forth Flow of Ink

The back-and-forth flow of ink previously described, will now be described more specifically.

Figure 6:
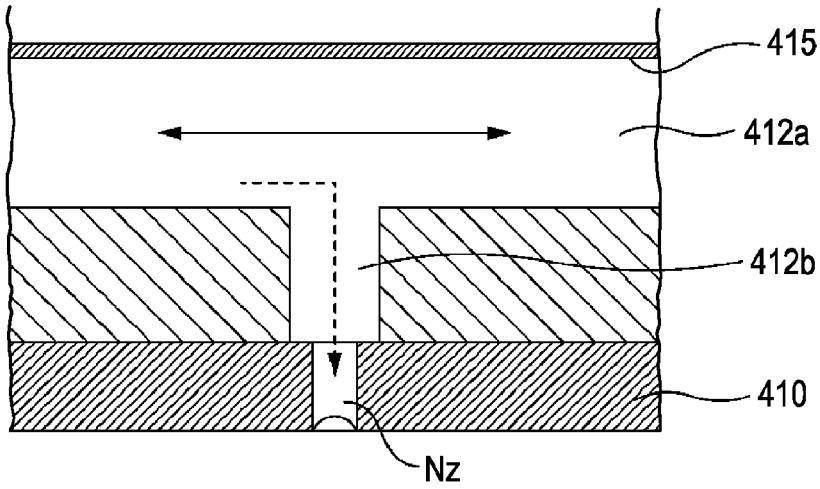
FIG. 6 shows the ink in the pressure chamber, which flows back and forth between the tanks.

The back-and-forth flow of ink between the main tank 31 and the subtank 32 allows the ink to flow through the recording head 41 disposed between the main tank 31 and the subtank 32, or more precisely, allows the ink to flow in an ink channel formed in the recording head 41. Accordingly, as shown in FIG. 6, the ink can flow through the pressure chamber 412 in the recording head 41. FIG. 6 shows the flow of the ink in the pressure chamber 412, which flows back and forth between the tanks 31 and 32, with the nozzle Nz being shown in an enlarged view.

The continuous flow of the ink in the pressure chamber 412 allows the ink in the pressure chamber 412 to be consistently and reliably supplied for ejection from the nozzle Nz.

Specifically speaking, if bubbles mixed into the ink are trapped in the pressure chamber 412 and allowed to accumulate around the nozzle Nz, the ink can not be properly ejected from the nozzle Nz. One advantage that may arise from using the invention, however, is that the bubbles can be removed from the area of the nozzle Nz by letting the ink continuously flow through the pressure chamber 412. Furthermore, the ink which flows of the pressure chamber 412 passes the first and second reservoirs 413*a* and 413*b* and the first and second inlet and outlet channels 414*a* and 414*b*, where it finally flows to the main tank 31 or the subtank 32, so that any bubbles that have been removed are also removed to the main tank 31 or the subtank 32. Thus, the bubbles mixed in the ink can be appropriately removed by letting the ink flow back and forth between the tanks 31 and 32.

If the ink is retained in the nozzle Nz without being ejected, the ink maintains contact with the air at the nozzle opening, causing the water or solvent in the ink to evaporate. Continued evaporation of the water increases the viscosity of the ink around the nozzle Nz, creating thickened ink. The thickening of the ink spreads from the interior of the nozzle Nz to the flat portion 412*a* of the pressure chamber 412 (particularly, the part of the flat portion 412*a* adjacent to the lead-in hole 412*b*). This makes the viscosity of the ink in the pressure chamber 412 uneven, creating difficulties in properly ejecting the ink from the nozzles Nz. If the ink becomes too thick, the ink may be stuck in the nozzle Nz, causing clogging in the nozzle Nz. To prevent the problems caused by inconsistencies in the viscosity of the ink, a maintenance process, such as flushing, may be performed, wherein the thickened ink is forcefully ejected from the nozzle Nz. However, letting ink flow through the recording head 41 can maintain uniform viscosity of the ink in the recording head 41 and pressure chamber 412. This may reduce the amount of ink using in flushing or other maintenance operations.

The resistance of the ink channel extending from one of the first and second reservoirs 413*a* and 413*b* to the other through the pressure chamber 412 in the recording head 41 is lower than the resistance of the ink channel extending from the first and second reservoirs 413*a* and 413*b* to the nozzle Nz through the pressure chamber 412. That is, the ink flowing back and forth does not flow not in the direction indicated by the dashed line in FIG. 6 but principally flows in the direction indicated by the solid line. As a result, when ink is flowing back and forth through the pressure chamber 412, the ink is not ejected from the nozzle Nz and no meniscus formed in the nozzle Nz unless the piezoelectric element 411 reduces the capacity of the pressure chamber 412.

Control for Letting Ink Flow Back and Forth

The back-and-forth flow of ink is achieved by the controller 10 alternating between the first control mode where the ink is moved from the main tank 31 to the subtank 32 and the second control mode wherein the ink is allowed to flow from the subtank 32 to the main tank 31. The first control mode is a mode in which the controller 10 operates the pressure pump 33, with the air release valve 34 closed. The second control mode is a mode in which the controller 10 stops the pressure pump 33 and opens the air release valve 34.

The second control mode includes a fast drop mode for allowing ink to quickly flow from the subtank 32 to the main tank 31 and a slow drop mode for allowing the ink to flow more slowly. The switching between the fast drop mode and the slow drop mode is controlled by the controller 10 controlling the channel selector valve 313. More specifically, the fast drop mode is a mode wherein the controller 10 controls the channel selector valve 313 to open only the low-resistance channel 311, through which ink flows from the subtank 32 to the main tank 31, while the slow drop mode is a mode wherein the controller 10 opens only the high-resistance channel 312 for the ink to flow therethrough. In one embodiment, when the slow drop mode is executed when the ink level of the subtank 32 is at the upper limit, the level of ink gradually decreases to reach the lower limit in a predetermined amount of time. In other words, the resistance of the high-resistance channel 312 is controlled so that it takes a predetermined amount of time for the ink level of the subtank 32 to be reduced from the upper limit to the lower limit.

The discharge pressure of the pressure pump 33 when the ink is being moved from the main tank 31 to the subtank 32 is sufficiently greater than the maximum value of the water head pressure when the ink is allowed to flow from the subtank 32 to the main tank 31 (that is, the difference in the water head between the subtank 32 and the main tank 31). Therefore, the time required to move a predetermined amount of ink from the main tank 31 to the subtank 32 in the first control mode is sufficiently shorter than the time required to allow the predetermined amount of ink to flow from the subtank 32 to the main tank 31 in the second control mode.

Figure 7A:
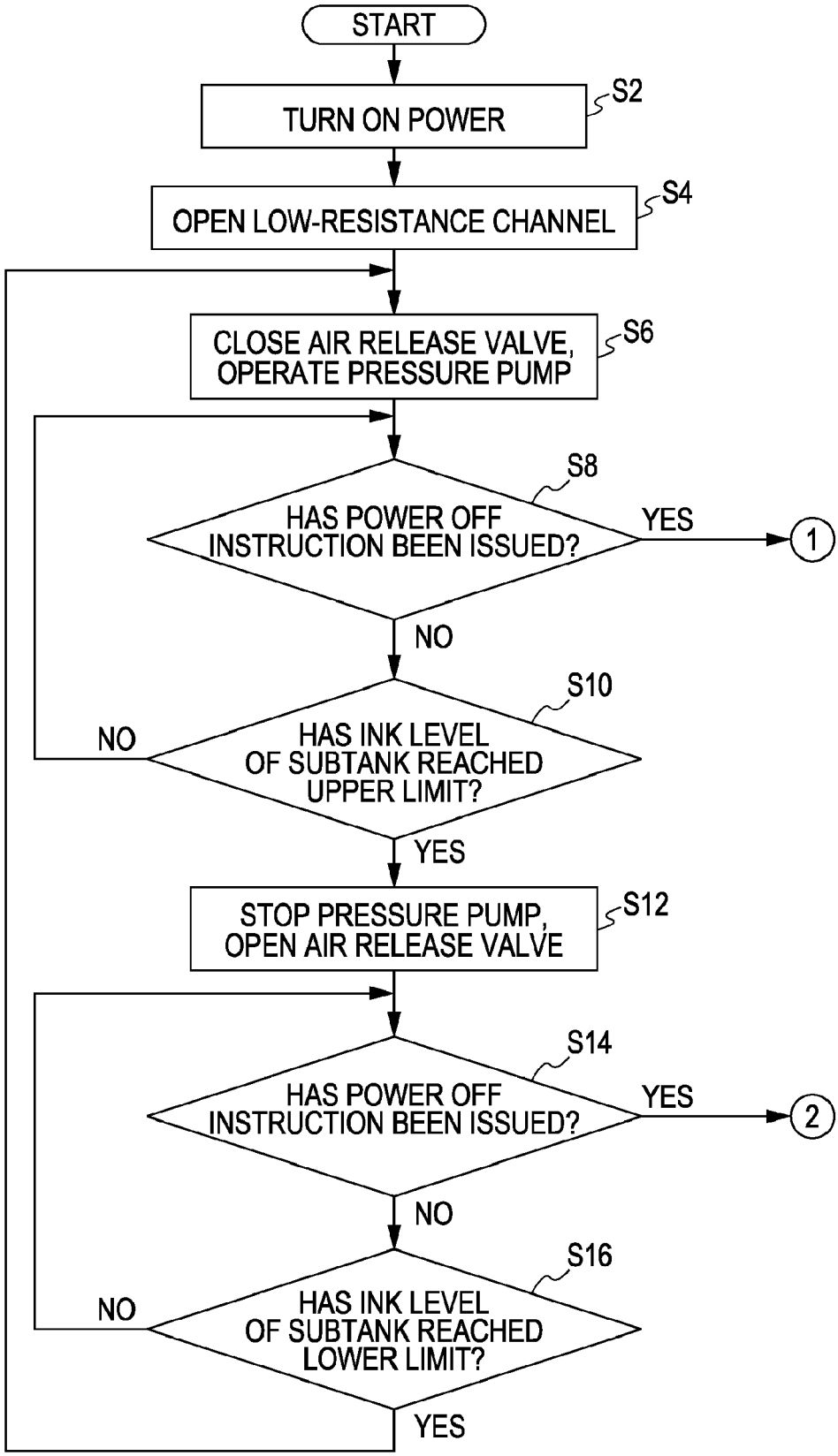
FIGS. 7A-7C are flowcharts illustrating the controls for letting the ink flow back and forth between the tanks.
Figure 7B:
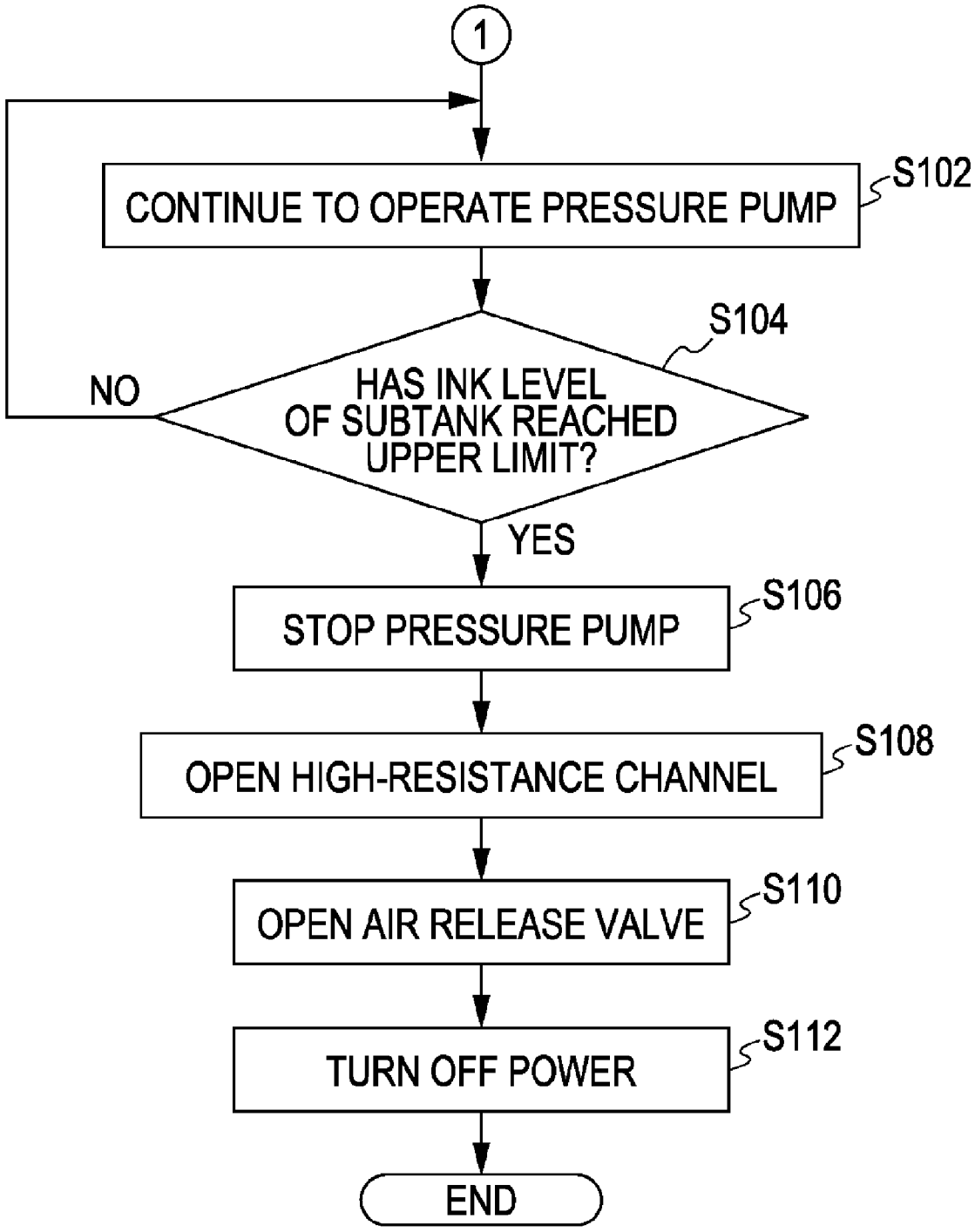
Figure 7C:
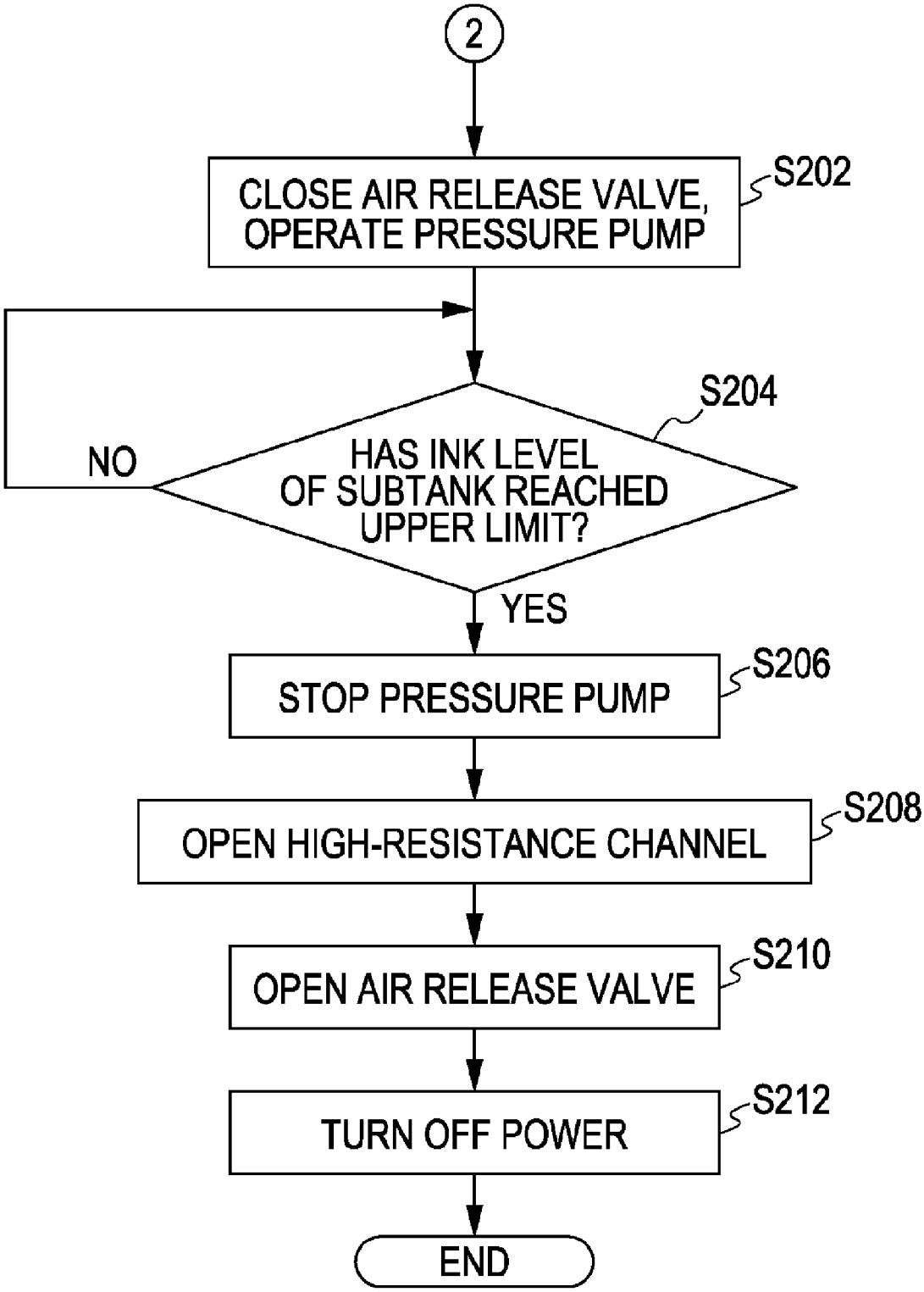

FIGS. 7A to 7C are flowcharts illustrating the process of controlling the ink flow between the subtank 32 and the main tank 31.

As shown in FIG. 7A, the process of controlling the ink flow back begins when the power of the printer 1 is turned on by the user, in order to supply the power to the components of the printer 1 (S2). When the power is turned on, the controller 10 controls the channel selector valve 313 in order to open only the low-resistance channel 311 (S4). Then, the controller 10 operates the pressure pump 33, with the air release valve 34 closed (S6). In other words, the controller 10 executes the first control mode immediately after the power is turned on. The controller 10 continues the first control mode unless a power-off instruction is received during the execution of the first control mode (No in S8). As the first control mode advances, the ink level of the subtank 32 increases. The first control mode is continued until the ink level reaches the upper limit of the subtank 32 (No in S10).

In this embodiment, the discharge pressure of the pressure pump 33 when drawing ink is sufficiently greater than the maximum value of the water head pressure when the ink is allowed to flow between the main tank 31 and the subtank 32. Therefore, the time required to transport a predetermined amount of ink to the subtank 32 is shorter in the first control mode than in the fast drop mode of the second control mode although the ink channels are the same in both modes. In other words, the time required to drop a predetermined amount of ink in the fast drop mode is longer than that to move a predetermined amount of ink in the first control mode. Specifically speaking, in this embodiment, the time required to move the ink until the ink level of the subtank 32 reaches the upper limit in the first control mode is about 5 to 10 seconds.

When the ink level reaches the upper limit, the upper level switch 61*a* outputs a first liquid level signal to the controller 10 (Yes in S10). Then, the controller 10 stops the pressure pump 33 and opens the air release valve 34 in response to the first liquid level signal (S12). In other words, upon reception of the first liquid level signal, the controller 10 switches from the first control mode to the second control mode. Since only the low-resistance channel 311 is opened in the second channel 302, the fast drop mode is executed as the second control mode. The controller 10 continues the second control mode (the fast drop mode) unless a request to turn off the power is received during the execution of the second control mode (No in S14). As the controller continues to operate the second control mode, the ink level of the subtank 32 deceases. The continues to execute the second control mode until the ink level reaches the lower limit of the subtank 32 (No in S16).

When the ink level reaches the lower limit, the lower level switch 61*b* outputs a second liquid level signal to the controller 10 (Yes in S16). The controller 10 in turn closes the air release valve 34 and operates the pressure pump 33 in response to the second liquid level signal in order to once again execute the first control mode.

The above control pattern is repeated during the when the printer 1 is turned on until the controller 10 receives an instruction to turn the power off. During the time before the instruction to turn the power off is received, the second control mode executes the fast drop mode.

In contrast, if the user turns off the power while the controller 10 is executing the first control mode, the controller 10 receives a power-off instruction responsive to the power off operation (Yes in S8). In this embodiment, the controller 10 waits to turn off the power until the following operation, illustrated in FIG. 7B, is performed.

First, as shown in FIG. 7B, when the power-off instruction is received, the controller 10 continues to operate the pressure pump 33 in the first control mode until the ink level of the subtank 32 reaches the upper limit (S102 and S104). When the ink level reaches the upper limit, the controller 10 receives the first liquid level signal from the upper level switch 61*a* (Yes in S104), and the controller 10 stops the pressure pump 33 (S106). Then, the controller 10 controls the channel selector valve 313 to open only the high-resistance channel 312 (S108). Thereafter, the controller 10 opens the air release valve 34 (S110), and turns off the power of the printer 1 (S112). Thus, upon reception of the power-off instruction when the first control mode is being executed, the controller 10 switches from the first control mode to the second control mode, and then turns off the power. In this embodiment, when the controller 10 switches from the first control mode to the second control mode, the first control mode is switched to the slow drop mode.

In addition, when the controller 10 gives the power-off instruction during the execution of the second control mode (fast drop mode), the controller 10 delays turning off the power until the following operation, illustrated in FIG. 7B, is performed.

First, as shown in FIG. 7C, upon receiving the power-off instruction (Yes in S14), the controller 10 closes the air release valve 34 and operates the pressure pump 33 (S202). In other words, upon receiving the power-off instruction during the execution of the second control mode, the controller 10 switches from the second control mode to the first control mode, and executes the first control mode. Thereafter, the controller 10 continues executing the first control mode until the ink level of the subtank 32 reaches the upper limit (S204). When the ink level reaches the upper limit, the controller 10 receives the first liquid level signal from the upper level switch 61*a* (Yes in S204), and stops the pressure pump 33 (S206). Then, the controller 10 controls the channel selector valve 313 in order to open only the high-resistance channel 312 (S208). The controller 10 then opens the air release valve 34 (S210), and turns off the power of the printer 1 (S212). Thus, when the power-off instruction is received during the execution of the second control mode, the controller 10 switches from the second control mode to the first control mode, executes the first control mode until a predetermined amount of ink is transferred to the subtank 32, switches back to the second control mode again, and then turns off the power. As in the above, when the controller 10 switches from the first control mode to the second control mode when turning off the power, the first control mode is switched to the slow drop mode.

As described above, since the controller 10 alternates between the first control mode and the second control mode while the printer 1 is turned on until the power-off instruction is given, the ink flows back and forth between the main tank 31 and the subtank 32.

After receiving the power-off instruction, the controller 10 turns off the power after switching the control mode. In this embodiment, the control mode is always switched to the second control mode when the power is turned off. This allows the ink to flow from the subtank 32 to the main tank 31 through the recording head 41 after the power is turned off. In short, the ink can flow through the recording head 41 after the power is turned off. The second control mode to which the controller 10 switches when turning off the power comprises the slow drop mode. Thus, after the power is turned off, the ink in the subtank 32 can slowly flows to the main tank 31.

The printer 1 of this embodiment is principally for commercial use, so that the power of the printer 1 stays ON during business hours and is turned OFF after business hours. Assuming such a configuration, the amount of ink drops per unit time is controlled so that the ink continuously flows from the subtank 32 to the main tank 31 during after business hours when the power is off. The amount of ink that is allowed to flow from the subtank 32 in a period of time depends on the resistance of the high-resistance channel 312 (for example, the opening of the valve v1). Accordingly, in this embodiment, the opening of the valve v1 is controlled so that the time during which the ink continuously flows (hereinafter, referred to as the ink flow time) from the subtank 32 to the main tank 31 is longer that the amount of time between business hours.

Specifically speaking, the ink flow time is controlled by adjusting the opening of the valve v1 (that is, the radius of the area corresponding to the opening of the valve v1). The approximate value of the ink flow time is obtained by multiplying the time required to move the ink to the subtank 32 (which is five seconds in one example) by the fourth power of the ratio of the inner radius of the low-resistance channel 311 to the ratio of the discharge pressure of the pressure pump 33 to the water head pressure (for example, the discharge pressure is 10 times the water head pressure). In this embodiment, the opening of the valve v1 is controlled so that the ratio of the inner radius of the low-resistance channel 311 to the radius of the corresponding circle is 10. This allows the ink flow time to approximate five days or more (specifically, 500,000 seconds), thereby allowing the ink to continuously flow during the period of time between business hours (for example, during the weekend).

The opening of the valve v1 is not limited to the above, but may be controlled so that the inner radius to the low-resistance channel 311 to the radius of the corresponding circle is 5.5. This allows the ink flow time to be maintained for about half a day, thus allowing the ink to continuously flow from the subtank 32 each weeknight when the business is closed.

Advantages of Printer of the Embodiment

The printer 1 of this embodiment includes the recording head 41 that ejects ink, a main tank 31 located lower than the recording head 41 which is capable of storing the ink, a subtank 32 located higher than the main tank 31 which is also capable of storing the ink, the pressure pump 33 that is capable of pumping the ink from the main tank 31 to the subtank 32 through the recording head 41, and a controller 10 which alternates between the first control mode wherein the pressure pump 33 pumps the ink from the main tank 31 to the subtank 32 and the second control mode wherein the ink is allowed to flow from the subtank 32 to the main tank 31 through the recording head 41. When the controller receives a request to turn off the printer 1, the controller 10 shifts the mode that the controller 10 is executing to the second control mode and then turns off the power of the printer 1. This allows the ink to flow through the recording head 41 after the power of the printer 1 is turned off.

As described above, from the viewpoint of preventing ink from staying in the recording head 41, it is preferable to let the ink flow between the main tank 31 and the subtank 32 through the recording head 41 also after the power is turned off.

To this end, in the printer 1 of this embodiment, when the controller 10 receives a power-off instruction during the execution of the first control mode, the controller 10 switches the first control mode to the second control mode, and then turns off the power of the printer 1. In other words, after the power is turned off, the ink stored in the subtank 32 flows to the main tank 31. Thus, the ink can be dropped from the subtank 32 to the main tank 31, allowing the ink to continuously flow through the recording head 41 after the power is turned off.

When the controller 10 receives the power-off instruction during the execution of the second control mode, the controller 10 switches from the second control mode to the first control mode in order to execute the first control mode, then switches from the first control mode to the second control mode, and then turns off the power. With this structure, after the fluid is drawn up to the second fluid storing section, the mode is switched from the first control mode to the second control mode and thereafter the power is turned off. This allows the fluid to flow through the recording head appropriately after the power is turned off. In other words, as in the above, the ink can flow from the subtank 32 to the main tank 31, allowing the ink to continuously flow through the recording head 41 after the power is turned off.

As described above, the printer 1 of the embodiment allows ink to flow through the recording head 41 after the power is turned off. This prevents the ink from accumulating in the recording head 41 after the power is turned off, thereby continuously preventing problems due to viscosity inconsistencies and the retention of the ink in the pressure chamber 412. Furthermore, this prevents inconsistencies in the viscosity of the ink in the pressure chamber 412, which in turn reduces the number of flushing operations, thereby reducing the amount of ink consumed by the flushing operations.

In this embodiment, when the power-off instruction is given during the execution of the first control mode, the controller 10 switches from the first control mode to the second control mode, and then turns off the power of the printer 1. Accordingly, the ink is drawn up to the subtank 32 before the power is turned off. This provides sufficient time to let the ink flow through the recording head 41 before the power is turned off. When the power-off instruction is given during the execution of the second control mode, the controller 10 switches from the second control mode to the first control mode to execute the first control mode, then switches from the first control mode to the second control mode, and then turns off the power. In other words, the ink can be drawn up to the subtank 32 before the power is turned off, as in the above. This provides sufficient time to let the ink flow through the recording head 41 before the power is turned off.

Other Embodiments

While the invention has been described about a fluid ejecting apparatus and a method for transporting fluid in the fluid ejecting apparatus according to one embodiment, it is to be understood to those skilled in the art that the embodiment is presented for ease of understanding of the invention and does not limit the invention. Accordingly, any and all modifications, variations or equivalent arrangements may be made without departing from the spirit and scope of the invention.

Figure 8:
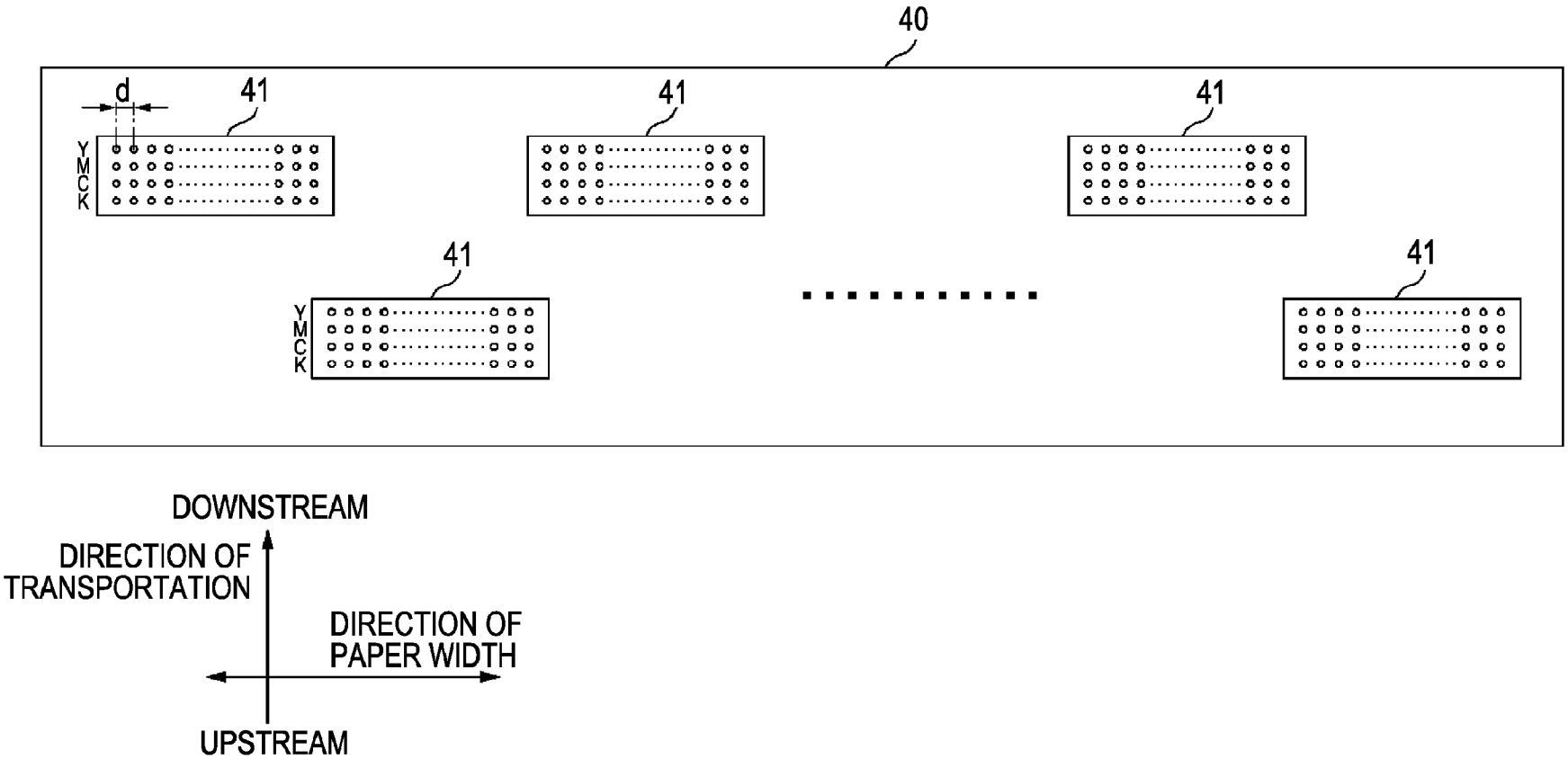
FIG. 8 is a diagram of another embodiment of the recording head unit.

In the above embodiment, the recording head unit 40 has the single recording head 41 shown in FIG. 3, although the invention is not so limited. For example, the recording head unit 40 may have a plurality of staggered recording heads 41 as shown in FIG. 8. FIG. 8 shows another embodiment of the recording head unit 40. The number of the nozzles of each recording head 41 shown in FIG. 8 is smaller than the number (n) of the nozzles of the recording head 41 shown in FIG. 3. Although the above embodiment was described using a line recording head printer as an example, the invention may be applied to a serial printer that prints while moving a carriage fitted with a recording head along the width of paper.

The above embodiment was described using an ink jet printer as an example of the fluid ejecting apparatus. The ink may be either water base ink or oil base ink. The fluid to be ejected is not limited to ink, however, and the invention may be embodied as a fluid ejecting apparatus that ejects another liquid other than ink (including liquid-form matter in which functional particles are dispersed and fluid-form matter such as gel, in addition to liquid) or fluid other than liquid (including flowing solid matter that can be ejected). For example, the invention may be applied to a liquid-form-matter ejecting apparatus that ejects liquid-form matter that contains a dispersed or dissolved electrode material or color material for use in manufacturing liquid crystal displays, electroluminescence (EL) displays, and surface emitting displays. The invention may also be embodied as a liquid ejecting apparatus that ejects bioorganic matter for use in manufacturing bio chips and as a liquid ejecting apparatus serving as a precision pipette that ejects a sample of liquid. Other applications include liquid ejecting apparatuses that eject lubricant to precision machines, such as watches and cameras, with pinpoint precision, liquid ejecting apparatuses that eject transparent resin liquid, such as ultraviolet curable resin, onto a substrate to form a microhemispherical lens (optical lens) for use in optical communication devices, liquid ejecting apparatuses that eject etching liquid, such as acid or alkali, in order to etch a substrate, fluid-form-matter ejecting apparatuses that eject gel, and a powder ejecting recording apparatuses that eject solid matter or powder such as toner. The invention can be applied to any one of those fluid ejecting apparatuses.

Although the printer 1 according to the embodiment is principally used for business, the invention is not limited to that. The printer 1 may be for private use. In such a case, the period in which the power is OFF may be extended. Therefore, it is desirable to control the amount of ink drops per unit time by controlling the resistance of the high-resistance channel 312 using the slow drop mode so that the time required for the ink level of the subtank 32 to reach the lower limit from the upper limit may be extended to a few weeks (for example, two weeks).

In order to reduce the evaporation of water from the ink held in the nozzles Nz more effectively in the above embodiment, the printer 1 may have a sealing member (a capping member) which is located under the nozzle plate 410 of the recording head 41 in order to seal the opening of each nozzle Nz by contact with the nozzle plate 410.

In the above embodiment, the second control mode includes the fast drop mode for dropping the ink in the subtank 32 faster and the slow drop mode for dropping the ink slower, and when a power-off instruction is given, the controller 10 turns off the power after shifting to the slow drop mode. However, the invention is not limited to this configuration, and the mode to be selected when the power is turned off may be the fast drop mode. However, the structure of the above embodiment allows the ink to be dropped from the subtank 32 to the main tank 31 more slowly, thereby allowing the ink to flow through the recording head 41 for a longer period of time after the power is turned off. Therefore, the above embodiment is more preferable.

In the above embodiment, the second channel 302 branches to two channels with different resistances in order to switch between the fast drop mode and the slow drop mode, and the channel selector valve 313 is provided at one end of the two branch channels, however the invention is not so limited. Alternatively, another method may be employed provided so that the time required to drop ink from the subtank 32 to the main tank 31 is differentiated. Furthermore, while the number and opening of the valves provided at the two branch channels are controlled to differentiate the resistances of the two branch channels, the invention is not so limited. For example, the difference in the resistance of the two branch channels may be provided by disposing a member other than the valves, such as an orifice, at the branch channels.

In the above embodiment, when the power-off instruction is given during the execution of the first control mode, the controller 10 continues the first control mode before switching from the first control mode to the second control mode. However, the invention is not so limited. For example, if the power-off instruction is given during the execution of the first control mode, the controller 10 may immediately switch from the first control mode to the second control mode. However, in the above embodiment, there is much more ink stored in the subtank 32 when the power is turned off than compared with the configuration when the mode is immediately switched from the first control mode to the second control mode. This allows the ink to flow through the recording head 41 longer after the power is turned off. Therefore, the above embodiment is more preferable.

In the above embodiment, the recording head 41 includes the first and second reservoirs 413*a* and 413*b* that communicate with each other through the pressure chamber 412, the first inlet and outlet channel 414*a* through which the ink passes between the first reservoir 413*a* and the main tank 31, and the second inlet and outlet channel 414*b* through which the ink passes between the second reservoir 413*b* and the subtank 32. However, the invention is not limited to that specific configuration. The first reservoir 413*a* may be connected to the first inlet and outlet channel 414*a* and an inlet and outlet channel (corresponding to the second inlet and outlet channel 414*b*) through which ink is input and output to/from the subtank 32. However, the configuration of the first embodiment allows the ink that flows between the tank 31 and 32 through the recording head 41 to easily flow between the first and second reservoirs 413*a* and 413*b* through the pressure chamber 412. In short, this facilitates the flow of ink in the pressure chamber 412. This prevents inconsistencies in the viscosity of the ink in the pressure chamber 412 more effectively. Therefore, the above embodiment is more preferable.

In the above embodiment, the level switches 61*a* and 61*b* are disposed in the subtank 32, and the controller 10 switches between the first control mode and the second control mode according to signals (the first ink level signal and the second ink level signal) output from the level switches 61*a* and 61*b* during the period after the power of the printer 1 is turned on until a power-off instruction is given. However, the invention is not limited to that configuration, and the signal output section may be mounted to the main tank 31 instead. Alternatively, the signal output section may not be mounted to either of the main tank 31 and the subtank 32. However, when the signal output section is mounted to the main tank 31 or the subtank 32, the controller 10 can appropriately switch between the first control mode and the second control mode according to a signal output from the signal output section. In this respect, the structure having the signal output section is more preferable.

What is claimed is:

1. A fluid ejecting apparatus comprising:

a head capable of ejecting fluid;

a first fluid storing section capable of storing the fluid that is located lower than the head;

a second fluid storing section capable of storing the fluid that is located higher than the first fluid storing section;

a pumping mechanism capable of moving the fluid through the head by moving the fluid from the first fluid storing section to the second fluid storing section; and a controller capable of alternating between a first control mode wherein the pumping mechanism moves the fluid from the first fluid storing section to the second fluid storing section and a second control mode wherein the fluid flows through the head from the second fluid storing section to the first fluid storing section, wherein the controller responds to a request to turn off the power to the apparatus by switching to the second control mode and then turning off the power to the fluid ejecting apparatus, wherein the second control mode includes a fast drop mode for quickly moving the fluid from the second fluid storing section to the first fluid storing section and a slow drop mode for moving the fluid from the second fluid storing section to the first fluid storing section more slowly; and wherein the controller responds to a request to turn off the power to the apparatus by shifting to the slow drop mode and then turning off the power to the fluid ejecting apparatus.

2. The fluid ejecting apparatus according to claim 1, wherein the fluid is allowed to flow in the fast drop mode to a channel having a lower resistance than the channel through which the fluid allowed to flow in the slow drop mode, and wherein in the first control mode, the pumping mechanism moves the fluid through the lower resistance channel in the fast drop mode.

3. The fluid ejecting apparatus according to claim 1, wherein the fast drop mode is executed when the controller executes the second control mode before the controller receives the request to turn off the power to the apparatus.

4. The fluid ejecting apparatus according to claim 1, wherein if the controller receives a request to turn off the power when the controller is executing the first control mode, the controller switches the mode from the first control mode to the second control mode, and then turns off the power to the fluid ejecting apparatus.

5. The fluid ejecting apparatus according to claim 4, wherein if the controller receives the power-off instruction when the controller is executing the first control mode, the controller continues executing the first control mode, switches to the second control mode, and then turns off the power to the fluid ejecting apparatus.

6. The fluid ejecting apparatus according to claim 1, wherein if the controller receives the power-off instruction when the controller is executing the second control mode, the controller switches to the first control mode to execute the first control mode, switches from the first control mode to the second control mode, and then turns off the power to the fluid ejecting apparatus.

7. The fluid ejecting apparatus according to claim 1, wherein the head comprises:

a nozzle capable of ejecting the fluid;

a pressure chamber adjacent to the nozzle with a variable internal pressure;

an element capable of causing the fluid to be ejected from the nozzle by varying the internal pressure of the pressure chamber;

first and second reservoirs capable of storing the fluid and communicating with each other through the pressure chamber;

a first inlet and outlet channel capable of transferring fluid between the first reservoir and the first fluid storing section; and a second inlet and outlet channel capable of transferring fluid between the second reservoir and the second fluid storing section.

8. The fluid ejecting apparatus according to claim 1, further comprising:

a signal output section capable of outputting a signal indicating the level of the fluid in the first fluid storing section or the second fluid storing section, wherein the controller switches between the first control mode and the second control mode according to the signal during the period of time after the power is turned on and the controller receives the request to turn off the power to the fluid ejecting apparatus.

9. A method for transporting fluid, comprising:

alternating between a first control mode wherein a pumping mechanism moves a fluid from a first fluid storing section to a second fluid storing section located higher than the first fluid storing section through a fluid ejecting head located higher than the first fluid storing section and a second control mode wherein the fluid is allowed to flow from the second fluid storing section to the first fluid storing section through the head from period of time between when the power of a fluid ejecting apparatus is turned on and when the apparatus receives an instruction to turn off the power to the apparatus;

shifting to the second control mode when apparatus receives an instruction to turn off the power to the apparatus; and turning off the power to the apparatus after shift to the second control mode, wherein the second control mode includes a fast drop mode for quickly moving the fluid from the second fluid storing section to the first fluid storing section and a slow drop mode for moving the fluid from the second fluid storing section to the first fluid storing section more slowly; and wherein the apparatus responds to a request to turn off the power by shifting to the slow drop mode and then turning off the power.

10. A fluid ejecting apparatus comprising:

a head capable of ejecting fluid;

a first fluid storing section connected to the head that is capable of storing the fluid that is ejected from the head, the first fluid storing section being located at a lower elevation than the head;

a second fluid storing section connected to the head that is capable of storing the fluid that is ejected from the head, the second fluid storing section being located at a higher elevation than the first fluid storing section;

a pumping mechanism capable of moving the fluid through the head by moving the liquid between the first fluid storing section to the second fluid storing section; and a controller capable of alternating between a first control mode wherein the pumping mechanism moves the fluid from the first fluid storing section, through the head, to the second fluid storing section and a second control mode wherein the fluid is allowed from the second fluid storing section, through the head, and to the first fluid storing section using the difference in water head between the first fluid storing section and the second fluid storing section, wherein the controller responds to a request to turn off the power to the apparatus by switching to the second control mode and then turning off the power to the fluid ejecting apparatus, wherein the second control mode includes a fast drop mode for quickly moving the fluid from the second fluid storing section to the first fluid storing section and a slow drop mode for moving the fluid from the second fluid storing section to the first fluid storing section more slowly; and wherein the controller responds to a request to turn off the power to the apparatus to shifting to the slow drop mode and then turning off the power to the fluid ejecting apparatus.

11. The fluid ejecting apparatus according to claim 10, wherein the fluid is allowed to flow in the fast drop mode to a channel having a lower resistance than the channel through which the fluid allowed to flow in the slow drop mode, and wherein in the first control mode, the pumping mechanism moves the fluid through the lower resistance channel in the fast drop mode.

12. The fluid ejecting apparatus according to claim 10, wherein the fast drop mode is executed when the controller executes the second control mode before the controller receives the request to turn off the power to the apparatus.

13. The fluid ejecting apparatus according to claim 10, wherein if the controller receives a request to turn off the power when the controller is executing the first control mode, the controller switches the mode from the first control mode to the second control mode, and then turns off the power to the fluid ejecting apparatus.

14. The fluid ejecting apparatus according to claim 13, wherein if the controller receives the power-off instruction when the controller is executing the first control mode, the controller continues executing the first control mode, switches to the second control mode, and then turns off the power to the fluid ejecting apparatus.

15. The fluid ejecting apparatus according to claim 10, wherein if the controller receives the power-off instruction when the controller is executing the second control mode, the controller switches to the first control mode to execute the first control mode, switches from the first control mode to the second control mode, and then turns off the power to the fluid ejecting apparatus.

16. The fluid ejecting apparatus according to claim 10, wherein the head comprises:

a nozzle capable of ejecting the fluid;

a pressure chamber adjacent to the nozzle with a variable internal pressure;

an element capable of causing the fluid to be ejected from the nozzle by varying the internal pressure of the pressure chamber;

first and second reservoirs capable of storing the fluid and communicating with each other through the pressure chamber;

a first inlet and outlet channel capable of transferring fluid between the first reservoir and the first fluid storing section; and a second inlet and outlet channel capable of transferring fluid between the second reservoir and the second fluid storing section.

17. The fluid ejecting apparatus according to claim 10, further comprising:

a signal output section capable of outputting a signal indicating the level of the fluid in the first fluid storing section or the second fluid storing section, wherein the controller switches between the first control mode and the second control mode according to the signal during the period of time after the power is turned on and the controller receives the request to turn off the power to the fluid ejecting apparatus.

* * * * *